US009034555B2

(12) United States Patent
Yamada et al.

(10) Patent No.: US 9,034,555 B2
(45) Date of Patent: May 19, 2015

(54) METHOD FOR PRODUCING LIQUID DEVELOPER

(71) Applicant: Kao Corporation, Chuo-ku (JP)

(72) Inventors: Tatsuya Yamada, Wakayama (JP); Hiromi Ito, Wakayama (JP); Yoko Hanada, Wakayama (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 14/140,915

(22) Filed: Dec. 26, 2013

(65) Prior Publication Data

US 2014/0186764 A1 Jul. 3, 2014

(30) Foreign Application Priority Data

Dec. 28, 2012 (JP) ..... 2012-286767

(51) Int. Cl.

| | |
|---|---|
| ***G03G 9/13*** | (2006.01) |
| ***G03G 9/135*** | (2006.01) |
| ***G03G 9/08*** | (2006.01) |
| ***G03G 9/12*** | (2006.01) |

(52) U.S. Cl.

CPC ..... *G03G 9/0804* (2013.01); *G03G 9/12* (2013.01); *G03G 9/132* (2013.01); *G03G 9/135* (2013.01); *G03G 9/1355* (2013.01)

(58) Field of Classification Search

CPC ..... G03G 9/12; G03G 9/122; G03G 9/125
USPC ..... 430/137.22
See application file for complete search history.

(56) References Cited

U.S. PATENT DOCUMENTS

| | | | | |
|---|---|---|---|---|
| 4,224,212 | A | 9/1980 | Topham | |
| 4,962,150 | A * | 10/1990 | Allen | 524/602 |
| 5,071,502 | A * | 12/1991 | Hashimoto et al. | 156/234 |
| 2008/0014526 | A1 | 1/2008 | Miura et al. | |
| 2009/0011359 | A1 | 1/2009 | Iwase et al. | |
| 2009/0238606 | A1 | 9/2009 | Ueno et al. | |

FOREIGN PATENT DOCUMENTS

| | | | |
|---|---|---|---|
| EP | 1 876 497 | A1 | 1/2008 |
| JP | 63-30057 | B2 | 6/1988 |
| JP | 2008-46596 | A | 2/2008 |
| JP | 2013-190657 | A | 9/2013 |
| JP | 2014-10164 | A | 1/2014 |
| WO | WO 00/46313 | A1 | 8/2000 |
| WO | WO 2006/118201 | A1 | 11/2006 |

OTHER PUBLICATIONS

Extended European Search Report issued Mar. 25, 2014 in Patent Application No. 13199486.5.
U.S. Appl. No. 14/135,987, filed Dec. 20, 2013, Yamada, et al.

* cited by examiner

*Primary Examiner* — Hoa V Le
(74) *Attorney, Agent, or Firm* — Oblon, McClelland, Maier & Neustadt, L.L.P.

(57) ABSTRACT

A method for producing a liquid developer containing toner particles containing a resin containing a polyester and a pigment, and an insulating liquid, wherein the toner particles are dispersed in the insulating liquid, including: step 1: melt-kneading the resin and the pigment, and pulverizing a melt-kneaded mixture to provide toner particles; step 2: dispersing the toner particles obtained in the step 1 in the insulating liquid in the presence of a basic dispersant to provide a dispersion of toner particles; and step 3: wet-milling the dispersion of toner particles obtained in the step 2 to provide a liquid developer, wherein the basic dispersant is an amide compound obtained by a reaction between a polyethyleneimine and a polyester (D) obtained by self-condensation of 12-hydroxystearic acid. The liquid developer obtained by the method of the present invention can be suitably used in development of latent images formed in, for example, an electrophotographic method, an electrostatic recording method, an electrostatic printing method, or the like.

18 Claims, No Drawings

METHOD FOR PRODUCING LIQUID DEVELOPER

FIELD OF THE INVENTION

The present invention relates to a method for producing a liquid developer usable in development of latent images formed in, for example, an electrophotographic method, an electrostatic recording method, an electrostatic printing method, or the like.

BACKGROUND OF THE INVENTION

Electrophotographic developers are a dry-state developer in which toner components containing materials containing a colorant and a resin binder in a dry state, and a liquid developer in which toner components are dispersed in an insulating carrier liquid.

Liquid developers allow the toner particles to form into smaller particles, so that they give excellent image quality, thereby making it suitable for commercial printing applications. In addition, in the recent years, with the increasing demands for speeding up, liquid developers with lowered viscosities are also in demand. In other words, liquid developers that are stably dispersed at smaller particle sizes and lower viscosities are in demand, and conventionally the dispersion stability as mentioned above is obtained with the use of a dispersant.

Patent Document 1 (Japanese Examined Patent Publication No. Sho-63-30057, corresponding to U.S. Pat. No. 4,224,212) discloses as a dispersant for dispersing a solid in an organic liquid, a dispersant comprising an amide or a salt formed by a reaction between a poly(lower alkyleneimine) and a polyester having a free carboxyl group, wherein at least two polyester chains are bonded to each of the poly(lower alkyleneimine) chains.

Patent Document 2 (Japanese Patent Laid-Open No. 2008-46596, corresponding to U.S. Patent Application Publication No. 2008/0014526) discloses a liquid developer in which toner particles are dispersed in an insulating liquid, characterized in that the insulating liquid containing a first vegetable oil and a reaction product formed by a transesterification reaction between a second vegetable oil and a monohydric alcohol, has excellent fusing properties of the toner particles to a recording medium.

Also, Patent Document 3 (WO 2006/118201) describes a liquid developer in which pigment-inclusion colored resin particles are dispersed in an insulating hydrocarbon-based organic solvent according to a wet-milling method using a dispersant, characterized in that the dispersant is a polyester side chain-containing carbodiimide compound in which a polyester side chain is introduced into the molecule of the carbodiimide compound via a reaction with a carbodiimide group, as a liquid developer which serves to suppress worsening influences to electric resistance of the liquid developer and triboelectric properties of toner particles minimally, to provide the liquid developer with improved dispersibility of a pigment and dispersion stability of toner particles.

SUMMARY OF THE INVENTION

The present invention relates to a method for producing a liquid developer containing toner particles containing a resin containing a polyester and a pigment, and an insulating liquid, wherein the toner particles are dispersed in the insulating liquid, including:

step 1: melt-kneading the resin and the pigment, and pulverizing a melt-kneaded mixture to provide toner particles;

step 2: dispersing the toner particles obtained in the step 1 in the insulating liquid in the presence of a basic dispersant to provide a dispersion of toner particles; and step 3: wet-milling the dispersion of toner particles obtained in the step 2 to provide a liquid developer, wherein the basic dispersant is an amide compound obtained by a reaction between a polyethyleneimine and a polyester (D) obtained by self-condensation of 12-hydroxystearic acid, wherein the polyethyleneimine has a number-average molecular weight of 1,000 or more and 2,600 or less, the polyester (D) has a number-average molecular weight of 1,000 or more and 2,500 or less, a molar ratio of the polyethyleneimine to the polyester (D), i.e. the polyethyleneimine/the polyester (D), is from 1/1 to 1/5, and the amide compound has a weight-average molecular weight of 2,000 or more and 7,500 or less.

DETAILED DESCRIPTION OF THE INVENTION

A liquid developer having high dispersion stability of the toner particles has some disadvantages that the toner particles are less likely to be aggregated upon fusing, so that a toner layer is less likely to be formed, thereby lowering fusing ability. According to conventional techniques, it is unsatisfactory as a liquid developer showing high fusing ability while retaining dispersion stability, i.e. storage stability.

The present invention relates to a method for producing a liquid developer having excellent dispersion stability and fusing ability of the toner particles.

According to the method of the present invention, a liquid developer having excellent dispersion stability and fusing ability of the toner particles is obtained.

The present invention has some features in the method for producing a liquid developer containing toner particles containing a resin and a pigment, and an insulating liquid, wherein the toner particles are dispersed in the insulating liquid, that a resin containing a polyester is used, and that an amide compound obtained by a reaction between a polyethyleneimine and a polyester (D) obtained by self-condensation of 12-hydroxystearic acid is used when the toner particles are dispersed in the insulating liquid. According to the method of the present invention, a liquid developer having excellent dispersion stability and fusing ability of the toner particles can be obtained.

The reasons why such effects are exhibited are not elucidated, and they are considered to be as follows.

In the amide compound obtained by a reaction between a polyethyleneimine and a polyester (D) obtained by self-condensation of 12-hydroxystearic acid, it is considered that a polyethyleneimine-derived component serves as a polyester-adsorbent group in the insulating liquid against the toner particles containing a polyester, and that the polyester obtained by self-condensation of 12-hydroxystearic acid functions as a dispersing group. At this time, since a polyethyleneimine having a low molecular weight is used, the amide compound can be adsorbed to the surface of the toner particles without being floated therefrom, so that bridging aggregation or the like between the particles via polyethyleneimine is suppressed, thereby improving dispersion stability of the toner particles. In addition, it is considered that a self-condensate of 12-hydroxystearic acid serves as a dispersing group, it contributes to the improvement of dispersion stability of toner particles in the insulating liquid, and at the same time the self-condensate of 12-hydroxystearic acid has an appropriate molecular weight, so that the self-condensate of 12-hydroxystearic acid has good compatibility with the polyester of the toner particles during fusing with heating, so that the function of the amide compound as a dispersant is lost, and aggregation between the toner particles is accelerated, thereby obtaining high fusing ability.

The method for producing a liquid developer of the present invention includes the following steps 1 to 3.

[Step 1]

The step 1 includes melt-kneading a resin and a pigment, and pulverizing a melt-kneaded mixture to provide toner particles.

[Resin]

The resin used in the present invention contains a polyester, from the viewpoint of improving fusing ability of a liquid developer, and from the viewpoint of improving dispersion stability of the toner particles in the liquid developer. The content of the polyester is preferably 90% by mass or more, more preferably 95% by mass or more, even more preferably substantially 100% by mass, and even more preferably 100% by mass, i.e. only the polyester is used as the resin, of the resin. Other resins may be contained within the range which would not impair the effects of the present invention. The resins other than the polyester include, for example, styrenic resins which are homopolymers or copolymers containing styrene or substituted styrenes, such as polystyrenes, styrene-propylene copolymers, styrene-butadiene copolymers, styrene-vinyl acetate copolymers, styrene-maleic acid copolymers, styrene-acrylate copolymers, and styrene-methacrylate copolymers; epoxy resins, rosin-modified maleic acid resins, polyethylene resins, polypropylene, polyurethane, silicone resins, phenolic resins, aliphatic or alicyclic hydrocarbon resins, and the like.

It is preferable that the polyester is obtained by polycondensing an alcohol component comprising a dihydric or higher polyhydric alcohol, and a carboxylic acid component comprising a dicarboxylic or higher polycarboxylic acid compound.

The dihydric alcohol includes diols having from 2 to 20 carbon atoms, and preferably from 2 to 15 carbon atoms; and an alkylene oxide adduct of bisphenol A represented by the formula (I):

(I)

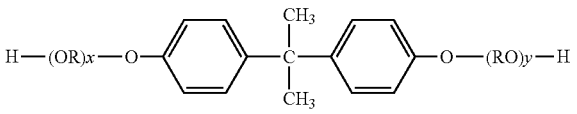

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4;

and the like. Specific examples of the dihydric alcohol having from 2 to 20 carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably 1,2-propanediol and the alkylene oxide adduct of bisphenol A represented by the formula (I), and more preferably the alkylene oxide adduct of bisphenol A represented by the formula (I), from the viewpoint of improving fusing ability of the liquid developer, and from the viewpoint of improving dispersion stability of toner particles in the liquid developer, thereby improving storage stability. The content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

The trihydric or higher polyhydric alcohol includes trihydric or higher polyhydric alcohols having from 3 to 20 carbon atoms, and preferably from 3 to 10 carbon atoms. Specific examples thereof include sorbitol, 1,4-sorbitan, pentaerythritol, glycerol, trimethylolpropane, and the like.

The dicarboxylic acid compound includes, for example, dicarboxylic acids having from 3 to 30 carbon atoms, preferably from 3 to 20 carbon atoms, and more preferably from 3 to 10 carbon atoms, and derivatives thereof such as acid anhydrides thereof, alkyl esters thereof in which alkyl group has from 1 to 3 carbon atoms, and the like. Specific examples include aromatic dicarboxylic acid such as phthalic acid, isophthalic acid, and terephthalic acid; and aliphatic dicarboxylic acid such as fumaric acid, maleic acid, succinic acid, glutaric acid, adipic acid, sebacic acid, succinic acid substituted with an alkyl group having from 1 to 20 carbon atoms or an alkenyl group having from 2 to 20 carbon atoms.

The tricarboxylic or higher polycarboxylic acid compound includes, for example, tricarboxylic or higher polycarboxylic acids having from 4 to 30 carbon atoms, preferably from 6 to 20 carbon atoms, and more preferably from 9 to 10 carbon atoms, derivatives thereof, such as acid anhydrides thereof and alkyl esters thereof in which alkyl group has from 1 to 3 carbon atoms, and the like. Specific examples include 1,2,4-benzenetricarboxylic acid, i.e. trimellitic acid, 1,2,4,5-benzenetetracarboxylic acid, i.e. pyromellitic acid, and the like.

The carboxylic acid component is preferably terephthalic acid, fumaric acid, and trimellitic anhydride, and more preferably terephthalic acid, from the viewpoint of improving fusing ability of the liquid developer.

Also, the alcohol component may properly contain a monohydric alcohol, and the carboxylic acid component may properly contain a monocarboxylic acid compound, from the viewpoint of adjusting the softening point of the polyester.

An equivalent ratio of the carboxylic acid component and the alcohol component in the polyester, i.e. COOH group or groups/OH group or groups, is preferably from 0.70 to 1.10, and more preferably from 0.75 to 1.00, from the viewpoint of adjusting the softening point of the polyester.

The polyester can be produced by polycondensing the alcohol component and the carboxylic acid component in an inert gas atmosphere at a temperature of from 180° to 250° C. or so, optionally in the presence of an esterification catalyst, an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. In addition, the amount of the esterification catalyst used is preferably from 0.01 to 1.5 parts by mass, and more preferably from 0.1 to 1.0 part by mass, based on 100 parts by mass of a total amount of the alcohol component and the carboxylic acid component. The amount of the esterification promoter used is preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The amount of the polymerization inhibitor used is preferably from 0.001 to 0.5 parts by mass, and more preferably from 0.01 to 0.1 parts by mass, based on 100 parts by mass of a total amount of the alcohol component and the carboxylic acid component.

In the present invention, it is preferable that the polyester in the resin contains a polyester (R) having a specified acid value. The content of the polyester (R) is preferably 90% by mass or more, more preferably 95% by mass or more, even more preferably substantially 100% by mass, and even more preferably 100% by mass, in other words, only the polyester (R) being used, of the resin.

The polyester (R) has an acid value of preferably 120 mgKOH/g or less, more preferably 100 mgKOH/g or less, even more preferably 80 mgKOH/g or less, even more preferably 60 mgKOH/g or less, even more preferably 40 mgKOH/g or less, and even more preferably 20 mgKOH/g or less, from the viewpoint of improving fusing ability of the liquid developer, from the viewpoint of reducing viscosity of the liquid developer, and from the viewpoint of improving dispersion stability of toner particles in the liquid developer, thereby improving storage stability. In addition, the polyester (R) has an acid value of preferably 1 mgKOH/g or more, more preferably 3 mgKOH/g or more, even more preferably 5 mgKOH/g or more, even more preferably 8 mgKOH/g or more, and even more preferably 10 mgKOH/g or more, from the same viewpoint. The acid value of the polyester can be adjusted by a method including varying an equivalent ratio of the carboxylic acid component and the alcohol component, varying a reaction time during the resin production, varying a content of the tricarboxylic or higher polycarboxylic acid compound, or the like.

The polyester (R) has a softening point of preferably 160° C. or lower, more preferably 130° C. or lower, even more preferably 120° C. or lower, and even more preferably 100° C. or lower, from the viewpoint of improving fusing ability of the liquid developer. In addition, the polyester (R) has a softening point of preferably 70° C. or higher, and more preferably 75° C. or higher, from the viewpoint of improving dispersion stability of the liquid developer, thereby improving storage stability.

The polyester (R) has a glass transition temperature of preferably 80° C. or lower, more preferably 70° C. or lower, and even more preferably 65° C. or lower, from the viewpoint of improving fusing ability of the liquid developer. Also, the polyester (R) has a glass transition temperature of preferably 40° C. or higher, and more preferably 45° C. or higher, from the viewpoint of improving dispersion stability of the liquid developer, thereby improving storage stability.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

[Pigment]

As the pigment, all of the pigments which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. In the present invention, the toner particles may be any of black toners and color toners.

The content of the pigment is preferably 100 parts by mass or less, more preferably 70 parts by mass or less, even more preferably 50 parts by mass or less, and even more preferably 25 parts by mass or less, based on 100 parts by mass of the resin, from the viewpoint of improving fusing ability of the liquid developer. In addition, the content of the pigment is preferably 5 parts by mass or more, more preferably 10 parts by mass or more, and even more preferably 15 parts by mass or more, based on 100 parts by mass of the resin, from the viewpoint of improving optical density of the liquid developer.

In the present invention, an additive such as a releasing agent, a charge control agent, a charge control resin, a magnetic particulate, a fluidity improver, an electric conductivity modifier, a reinforcing filler such as a fibrous material, an antioxidant, or a cleanability improver may be further properly used as a toner material.

[Method for Producing Toner Particles]

In the step 1, the method for obtaining toner particles includes a method including melt-kneading toner raw materials containing a resin and a pigment, and pulverizing the melt-kneaded mixture obtained to provide toner particles; a method including mixing an aqueous resin dispersion and an aqueous pigment dispersion, thereby unifying the resin particles and the pigment particles; and a method including stirring an aqueous resin dispersion and a pigment at high speed; and the like. The method including melt-kneading toner raw materials, and pulverizing the melt-kneaded mixture obtained is preferred, from the viewpoint of improving developing ability and fusing ability of the liquid developer.

The melt-kneading of toner raw materials can be carried out with a known kneader, such as a closed kneader, a single-screw or twin-screw kneader, or an open-roller type kneader. In the method for producing a liquid developer of the present invention, it is preferable that the melt-kneading is carried out with an open-roller type kneader, from the viewpoint of improving dispersibility of the pigment in the resin, and from the viewpoint of improving an yield of the toner particles after pulverization.

It is preferable that the toner raw materials containing a resin and a pigment are previously mixed with a mixer such as a Henschel mixer, a Super mixer or a ball-mill, and thereafter fed to a kneader. Among these mixers, Henschel mixer is preferred, from the viewpoint of improving dispersibility of the pigment in the resin.

The mixing of the toner raw materials with a Henschel mixer is carried out by adjusting a peripheral speed of agitation, and a mixing time. The peripheral speed of agitation is preferably from 10 to 30 m/sec, from the viewpoint of improving dispersibility of the pigment in the resin. In addition, the agitation time is preferably from 1 to 10 minutes, from the viewpoint of improving dispersibility of the pigment in the resin.

The open-roller type kneader refers to a kneader of which kneading unit is an open type, not being tightly closed, and the kneading heat generated during the melt-kneading can be easily dissipated. The open-roller type kneader used in the present invention is provided with a plurality of feeding ports for raw materials and a discharging port for a kneaded mixture along the shaft direction of the roller, and it is preferable that the open roller-kneader is a continuous open roller-type kneader, from the viewpoint of production efficiency.

It is preferable that the open-roller type kneader used in the present invention is provided with at least two kneading rollers having different temperatures. The temperature of the rollers can be adjusted by, for example, a temperature of a heating medium passing through the inner portion of the rollers, and each of the rollers may be divided in two or more portions in the inner portion of the rollers, the rollers being passed through with heating media of different temperatures.

In the present invention, it is preferable that in both of the rollers, the temperature of the discharge port for a kneaded mixture of the kneader is set at a temperature lower than the temperature which is 10° C. higher than softening point of the resin, from the viewpoint of improving miscibility of the toner raw materials.

It is preferable that the set temperature of the upstream side of kneading and the set temperature of the downstream side of kneading in the heat roller are such that the set temperature of the upstream side is higher than that of the downstream side, from the viewpoint of making the adhesiveness of the kneaded mixture to the roller at an upstream side favorable and strongly kneading at a downstream side.

In the roller of which set temperature at an upstream side of kneading is lower, which is also referred to as a cooling roller, the set temperature at an upstream side of kneading may be the same as or different from the set temperature of the downstream side of kneading.

The rollers of the open roller-type kneader are preferably those having peripheral speeds that are different from each other. In the open roller-type kneader provided with the heat roller and the cooling roller mentioned above, it is preferable that the heat roller is a roller having a higher peripheral speed, i.e. a high-rotation roller, and that the cooling roller is a roller having a lower peripheral speed, i.e. a low-rotation roller, from the viewpoint of improving fusing ability of the liquid developer.

The peripheral speed of the high-rotation roller is preferably from 2 to 100 m/min, and more preferably from 5 to 75 m/min. The peripheral speed of the low-rotation roller is preferably from 2 to 100 m/min, more preferably from 4 to 60 m/min, and even more preferably from 4 to 50 m/min. In addition, the ratio of the peripheral speeds of the two rollers, i.e. low-rotation roller/high-rotation roller, is preferably from 1/10 to 9/10, and more preferably from 3/10 to 8/10.

The gap between the two rollers, i.e. clearance, at an end part on the upstream side of the kneading is preferably from 0.1 to 3 mm, and more preferably from 0.1 to 1 mm.

Structures, size, materials and the like of each the rollers are not particularly limited. The surface of the roller contains a groove used in kneading, and the shapes of grooves include linear, spiral, wavy, rugged or other forms.

The feeding rates and the average residence time of the raw material mixture differ depending upon the size of the rollers used, components of the raw materials, and the like, so that optimal conditions among these conditions may be selected.

The kneaded mixture obtained by melt-kneading the components with an open roller-type kneader is cooled to an extent that is pulverizable, and subjecting the obtained mixture to ordinary processes such as a pulverizing step and optionally a classifying step, whereby the toner particles of the present invention can be obtained.

The pulverizing step may be carried out in divided multi-stages. For example, the melt-kneaded mixture may be roughly pulverized to a size of from 1 to 5 mm or so, and the roughly pulverized product may then be further finely pulverized. In addition, in order to improve productivity during the pulverizing step, the melt-kneaded mixture may be mixed with fine inorganic particles made of hydrophobic silica or the like, and then pulverized.

The pulverizer usable in the pulverizing step is not particularly limited. For example, the pulverizer suitably used in the rough pulverization includes an atomizer, Rotoplex, and the like, or a hammer-mill or the like may be used. The pulverizer suitably used in the fine pulverization includes a fluidised bed opposed jet mill, an air jet mill, a rotary mechanical mill, and the like.

The above pulverized product may be classified with a classifier as occasion demands. The classifier used in the classification step includes an air classifier, a rotor type classifier, a sieve classifier, and the like. The pulverized product which is insufficiently pulverized and removed during the classifying step may be subjected to the pulverizing step again, and the pulverizing step and the classifying step may be repeated as occasion demands.

The toner particles obtained in the step 1 have a volume-median particle size $D_{50}$ of preferably from 3 to 15 μm, and more preferably from 4 to 12 μm, from the viewpoint of improving productivity of the wet-milling step of the step 3. The volume-median particle size $D_{50}$ as used herein means a particle size of which cumulative volume frequency calculated on a volume percentage is 50% counted from the smaller particle sizes.

[Step 2]

The step 2 includes dispersing the toner particles obtained in the step 1 in an insulating liquid in the presence of a basic dispersant to provide a dispersion of toner particles.

The toner particles obtained in the step 1 are dispersed in an insulating liquid in the presence of a basic dispersant to provide a liquid developer. It is preferable that a liquid developer is obtained by dispersing toner particles in an insulating liquid, and thereafter subjecting the toner particles to wet-milling, from the viewpoint of making particle sizes of toner particles smaller in a liquid developer, and from the viewpoint of improving dispersibility of the toner particles in a liquid developer, thereby reducing viscosity of the liquid developer.

[Basic Dispersant]

A dispersant is used for the purpose of stably dispersing toner particles in an insulating liquid, and in the present invention, an amide compound obtained by a reaction between a polyethyleneimine and a polyester (D) obtained by self-condensation of 12-hydroxystearic acid is used, from the viewpoint of improving adsorbability to the resin, particularly a polyester, from the viewpoint of improving dispersion stability of the toner particles in a liquid developer, thereby improving storage stability, and from the viewpoint of improving fusing ability of a liquid developer.

The amide compound obtained by a reaction between a polyethyleneimine and a polyester (D) obtained by self-condensation of 12-hydroxystearic acid can be obtained by mixing the polyethyleneimine and the polyester (D) optionally while heating at a temperature of from 80° to 170° C. or so to react the components.

The polyethyleneimine has a number-average molecular weight of 1,000 or more, preferably 1,200 or more, and more preferably 1,400 or more, from the viewpoint of increasing adsorbability of the dispersant to the toner particles, from the viewpoint of improving fusing ability of a liquid developer, and from the viewpoint of improving dispersion stability of toner particles in a liquid developer, thereby improving storage stability. In addition, the polyethyleneimine has a number-average molecular weight of 2,600 or less, preferably 2,580 or less, more preferably 2,500 or less, even more preferably 2,000 or less, and even more preferably 1,800 or less, from the viewpoint of suppressing aggregation of the toner particles, from the viewpoint of improving fusing ability of a liquid developer, and from the viewpoint of improving dispersion stability of toner particles in a liquid developer, thereby improving storage stability. Here, the number-average molecular weight of the polyethylene is measured in accordance with a method described in Examples set forth below.

The polyester (D) obtained by self-condensation of 12-hydroxystearic acid can be produced, for example, by subjecting 12-hydroxystearic acid to self-condensation at a temperature of from 180° to 250° C. or so in an inert gas atmosphere, optionally in the presence of an esterification catalyst, an esterification promoter, a solvent or the like.

The self-condensate of 12-hydroxystearic acid, i.e. a polyester (D), has a number-average molecular weight of 1,000 or more, preferably 1,100 or more, more preferably 1,200 or more, and even more preferably 1,500 or more, from the viewpoint of improving dispersion stability of the toner particles in a liquid developer, thereby improving storage stability. In addition, the polyester (D) has a number-average molecular weight of 2,500 or less, preferably 2,200 or less, more preferably 2,000 or less, and even more preferably 1,800 or less, from the viewpoint of improving fusing ability of a liquid developer. Here, the number-average molecular weight of the self-condensate of 12-hydroxystearic acid, i.e. a polyester (D), is measured in accordance with a method described in Examples set forth below.

The self-condensate of 12-hydroxystearic acid, i.e. a polyester (D), has an acid value of preferably 10 mgKOH/g or more, more preferably 30 mgKOH/g or more, even more preferably 50 mgKOH/g or more, and even more preferably 60 mgKOH/g or more, from the viewpoint of improving fusing ability of a liquid developer. In addition, the polyester (D) has an acid value of preferably 150 mgKOH/g or less, more preferably 130 mgKOH/g or less, even more preferably 110 mgKOH/g or less, and even more preferably 90 mgKOH/g or less, from the viewpoint of improving dispersion stability of the toner particles in a liquid developer, thereby improving storage stability.

The molar ratio of the polyethyleneimine to the polyester (D), i.e. the polyethyleneimine/the polyester (D), in the amide compound obtained by a reaction between the polyethyleneimine and the polyester (D) is from 1/1 to 1/5, preferably from 1/1 to 1/4, more preferably from 1/1.3 to 1/3, and even more preferably from 1/1.5 to 1/2.5, from the viewpoint of improving fusing ability of a liquid developer and from the viewpoint of improving dispersion stability of the toner particles in a liquid developer, thereby improving storage stability.

The amide compound obtained by a reaction between the polyethyleneimine and the polyester (D) has a weight-average molecular weight of 2,000 or more, preferably 3,000 or more, more preferably 4,000 or more, and even more preferably 4,200 or more, from the viewpoint of improving dispersion stability of the toner particles in a liquid developer, thereby improving storage stability. In addition, the amide compound has a weight-average molecular weight of 7,500 or less, preferably 6,000 or less, more preferably 5,500 or less, even more preferably 5,000 or less, and even more preferably 4,800 or less, from the viewpoint of improving fusing ability of a liquid developer. Here, the weight-average molecular weight of the amide compound is measured in accordance with a method described in Examples set forth below.

The amount of the basic dispersant used is preferably 1 part by mass or more, more preferably 2 parts by mass or more, even more preferably 3 parts by mass or more, and even more preferably 4 parts by mass or more, based on 100 parts by mass of the toner particles, from the viewpoint of suppressing aggregation of the toner particles, thereby reducing viscosity of a liquid developer, and from the viewpoint of improving dispersion stability of the toner particles in a liquid developer, thereby improving storage stability. In addition, the amount of the basic dispersant used is preferably 20 parts by mass or less, more preferably 15 parts by mass or less, even more preferably 12 parts by mass or less, even more preferably 10 parts by mass or less, and even more preferably 8 parts by mass or less, based on 100 parts by mass of the toner particles, from the viewpoint of improving developing ability and fusing ability of a liquid developer, and from the viewpoint of improving dispersion stability of the toner particles in a liquid developer, thereby improving storage stability.

[Insulating Liquid]

The insulating liquid has a viscosity at 25° C. of preferably 1 mPa·s or more, more preferably 2 mPa·s or more, and even more preferably 3 mPa·s or more, from the viewpoint of improving fusing ability of a liquid developer, and from the viewpoint of improving dispersion stability of the toner particles in a liquid developer, thereby improving storage stability. In addition, the insulating liquid has a viscosity at 25° C. of preferably 55 mPa·s or less, more preferably 30 mPa·s or less, even more preferably 20 mPa·s or less, and even more preferably 10 mPa·s or less, from the viewpoint of improving dispersion stability of the toner particles in a liquid developer, thereby improving storage stability. When two or more kinds of insulating liquids are used in combination, the combined insulating liquid mixture may have a viscosity within the range defined above. Here, the viscosity of the insulating liquid at 25° C. is measured in accordance with a method described in Examples set forth below.

The insulating liquid means a liquid through which electricity is less like to flow, and in the present invention, a liquid having a dielectric constant of 3.5 or less and a volume resistivity of $10^7$ Ωcm or more is preferred.

Specific examples of the insulating liquid include, for example, aliphatic hydrocarbons, alicyclic hydrocarbons, aromatic hydrocarbons, halogenated hydrocarbons, polysiloxanes, vegetable oils, and the like. In particular, the aliphatic hydrocarbons such as liquid paraffin and isoparaffin are preferred, from the viewpoint of odor, harmlessness, and costs. Commercially available products of the aliphatic hydrocarbons include Isopar G, Isopar H, Isopar L, Isopar K, hereinabove commercially available from Exxon Mobile Corporation; ShellSol 71 commercially available from Shell Chemicals Japan Ltd; IP Solvent 1620, IP Solvent 2080, hereinabove commercially available from Idemitsu Kosan Co., Ltd.; MORESCO WHITE P-55, MORESCO WHITE P-70, MORESCO WHITE P-100, MORESCO WHITE P-150, MORESCO WHITE P-260, hereinabove commercially available from MORESCO Corporation; Cosmo White P-60, Cosmo White P-70, hereinabove commercially available from COSMO OIL LUBRICANTS, CO., LTD.: Lytol commercially available from Sonneborn; and the like. Among them, one of them or two or more in combination can be used.

It is preferable that a method for mixing toner particles, an insulating liquid, and a basic dispersant is a method including stirring the components with an agitation mixer.

The agitation mixer is, but not particularly limited to, preferably high-speed agitation mixers, from the viewpoint of improving productivity of the dispersion of toner particles. Specific examples are preferably DESPA commercially available from ASADA IRON WORKS CO., LTD.; T.K. HOMOGENIZING MIXER, T.K. HOMOGENIZING DISPER, T.K. ROBOMIX, hereinabove commercially available from PRIMIX Corporation; CLEARMIX commercially available from M Technique Co., Ltd; KADY Mill commercially available from KADY International, and the like.

The toner particles are previously dispersed by mixing toner particles, an insulating liquid, and a basic dispersant with a high-speed agitation mixer, whereby a dispersion of toner particles can be obtained, which in turn improves productivity of a liquid developer obtained in the subsequent wet-milling.

The solid content concentration of the dispersion of toner particles is preferably 20% by mass or more, more preferably 30% by mass or more, and even more preferably 35% by mass or more, from the viewpoint of improving developing ability of the liquid developer. In addition, the solid content concentration of the dispersion is preferably 50% by mass or less, more preferably 45% by mass or less, and even more preferably 40% by mass or less, from the viewpoint of improving dispersion stability of the toner particles in a liquid developer, thereby improving storage stability. Here, the solid content concentration of the dispersion of toner particles is measured in accordance with a method described in Examples set forth below.

[Step 3]

The step 3 is a step of wet-milling the dispersion of toner particles obtained in the step 2 to provide a liquid developer.

[Wet-Milling]

The wet-milling is a method of subjecting toner particles dispersed in an insulating liquid to a mechanical milling treatment in a state that the toner particles are dispersed in the insulating liquid.

As the apparatus used in the wet-milling, for example, generally used agitation mixers such as anchor blades can be used. The agitation mixers include high-speed agitation mixers such as DESPA commercially available from ASADA IRON WORKS CO., LTD., and T.K. HOMOGENIZING MIXER commercially available from PRIMIX Corporation; pulverizers and kneaders, such as roller mills, bead mills, kneaders, and extruders; and the like. These apparatuses can be combined in a plurality.

Among them, the bead mills are preferably used, from the viewpoint of making particle sizes of the toner particles in a liquid developer smaller, from the viewpoint of improving dispersibility of the toner particles in an insulating liquid, thereby improving storage stability, and from the viewpoint of reducing viscosity of the dispersion of toner particles.

By controlling particle sizes and filling ratios of media used, peripheral speed of rotors, residence time, and the like in the bead mill, toner particles having a desired particle size and a particle size distribution can be obtained.

The solid content concentration of the liquid developer obtained in the step 3 is preferably 20% by mass or more, more preferably 30% by mass or more, and even more preferably 35% by mass or more, from the viewpoint of improving developing ability of the liquid developer. Also, the solid content concentration of the liquid developer is preferably 50% by mass or less, more preferably 45% by mass or less, and even more preferably 40% by mass or less, from the viewpoint of improving dispersion stability of the toner particles in the liquid developer, thereby improving storage stability. Here, the solid content concentration of the liquid developer is measured in accordance with a method described in Examples set forth below. After the preparation of the dispersion of toner particles, the solid content concentration of the dispersion of toner particles would be a solid content concentration of the liquid developer unless the dispersion is subjected to such a procedure as dilution or concentration.

The toner particles in a liquid developer obtained in the step 3 have a volume-median particle size $D_{50}$ of preferably 5 μm or less, more preferably 3 μm or less, and even more preferably 2.5 μm or less, from the viewpoint of making particle sizes of the toner particles in a liquid developer smaller, thereby improving image quality of the liquid developer. In addition, the toner particles in a liquid developer have a volume-median particle size $D_{50}$ of preferably 0.5 μm or more, more preferably 1.0 μm or more, and even more preferably 1.5 μm or more, from the viewpoint of reducing viscosity of a liquid developer. Here, the volume-median particle size $D_{50}$ of the toner particles in a liquid developer is measured in accordance with a method described in Examples set forth below.

The liquid developer has a viscosity at 25° C. of preferably 200 mPa·s or less, more preferably 150 mPa·s or less, even more preferably 100 mPa·s or less, even more preferably 80 mPa·s or less, even more preferably 60 mPa·s or less, and even more preferably 50 mPa·s or less, from the viewpoint of improving developing ability of a liquid developer. In addition, the liquid developer has a viscosity at 25° C. of preferably 2 mPa·s or more, more preferably 5 mPa·s or more, even more preferably 10 mPa·s or more, and even more preferably 20 mPa·s or more, from the viewpoint of improving dispersion stability of the toner particles in a liquid developer, thereby improving storage stability. Here, the viscosity of a liquid developer is measured in accordance with a method described in Examples set forth below.

With regard to the embodiments described above, the present invention further disclose the following liquid developer.

<1> A method for producing a liquid developer containing toner particles containing a resin containing a polyester and a pigment, and an insulating liquid, wherein the toner particles are dispersed in the insulating liquid, including:

step 1: melt-kneading the resin and the pigment, and pulverizing a melt-kneaded mixture to provide toner particles;

step 2: dispersing the toner particles obtained in the step 1 in the insulating liquid in the presence of a basic dispersant to provide a dispersion of toner particles; and step 3: wet-milling the dispersion of toner particles obtained in the step 2 to provide a liquid developer, wherein the basic dispersant is an amide compound obtained by a reaction between a polyethyleneimine and a polyester (D) obtained by self-condensation of 12-hydroxystearic acid, wherein the polyethyleneimine has a number-average molecular weight of 1,000 or more and 2,600 or less, the polyester (D) has a number-average molecular weight of 1,000 or more and 2,500 or less, a molar ratio of the polyethyleneimine to the polyester (D), i.e. the polyethyleneimine/the polyester (D), is from 1/1 to 1/5, and the amide compound has a weight-average molecular weight of 2,000 or more and 7,500 or less.

<2> The method according to the above <1>, wherein the content of the polyester is preferably 90% by mass or more, more preferably 95% by mass or more, even more preferably substantially 100% by mass, and even more preferably 100% by mass, i.e. only the polyester is used as the resin, of the resin.

<3> The method according to the above <1> or <2>, wherein the polyester is preferably obtained by polycondensing an alcohol component containing a dihydric or higher polyhydric alcohol, and a carboxylic acid component containing a dicarboxylic or higher polycarboxylic acid compound.

<4> The method according to the above <3>, wherein the alcohol component is an alkylene oxide adduct of bisphenol A represented by the formula (I).

<5> The method according to the above <4>, wherein the content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

<6> The method according to any one of the above <3> to <5>, wherein the carboxylic acid component preferably contains at least one member selected from the group consisting of terephthalic acid, fumaric acid, and trimellitic anhydride, and more preferably containing terephthalic acid.

<7> The method according to any one of the above <1> to <6>, wherein the polyester in the resin contains a polyester (R) having an acid value of 3 mgKOH/g or more and 100 mgKOH/g or less.

<8> The method according to the above <7>, wherein the content of the polyester (R) is preferably 90% by mass or more, more preferably 95% by mass or more, even more preferably substantially 100% by mass, and even more preferably 100% by mass, in other words, only the polyester (R) being used, of the resin.

<9> The method according to the above <7> or <8>, wherein the polyester (R) has an acid value of preferably 120 mgKOH/g or less, more preferably 100 mgKOH/g or less, even more preferably 80 mgKOH/g or less, even more preferably 60 mgKOH/g or less, even more preferably 40 mgKOH/g or less, and even more preferably 20 mgKOH/g or less, and preferably 1 mgKOH/g or more, more preferably 3 mgKOH/g or more, even more preferably 5 mgKOH/g or more, even more preferably 8 mgKOH/g or more, and even more preferably 10 mgKOH/g or more.

<10> The method according to any one of the above <7> to <9>, wherein the polyester (R) has a softening point of preferably 160° C. or lower, more preferably 130° C. or lower, even more preferably 120° C. or lower, and even more preferably 100° C. or lower, and preferably 70° C. or higher, and more preferably 75° C. or higher.

<11> The method according to any one of the above <7> to <10>, wherein the polyester (R) has a glass transition temperature of preferably 80° C. or lower, more preferably 70° C. or lower, and even more preferably 65° C. or lower, and preferably 40° C. or higher, and more preferably 45° C. or higher.

<12> The method according to any one of the above <1> to <11>, wherein the content of the pigment is preferably 100 parts by mass or less, more preferably 70 parts by mass or less, even more preferably 50 parts by mass or less, and even more preferably 25 parts by mass or less, and preferably 5 parts by mass or more, more preferably 10 parts by mass or more, and even more preferably 15 parts by mass or more, based on 100 parts by mass of the resin.

<13> The method according to any one of the above <1> to <12>, wherein the polyethyleneimine has a number-average molecular weight of preferably 1,200 or more, and more preferably 1,400 or more, and preferably 2,580 or less, more preferably 2,500 or less, even more preferably 2,000 or less, and even more preferably 1,800 or less.

<14> The method according to any one of the above <1> to <13>, wherein the polyester (D) has a number-average molecular weight of preferably 1,100 or more, more preferably 1,200 or more, and even more preferably 1,500 or more, and preferably 2,200 or less, more preferably 2,000 or less, and even more preferably 1,800 or less.

<15> The method according to any one of the above <1> to <14>, wherein the polyester (D) has an acid value of preferably 10 mgKOH/g or more, more preferably 30 mgKOH/g or more, even more preferably 50 mgKOH/g or more, and even more preferably 60 mgKOH/g or more, and preferably 150 mgKOH/g or less, more preferably 130 mgKOH/g or less, even more preferably 110 mgKOH/g or less, and even more preferably 90 mgKOH/g or less.

<16> The method according to any one of the above <1> to <15>, wherein in the amide compound obtained by a reaction between the polyethyleneimine and the polyester (D), the molar ratio of the polyethyleneimine to the polyester (D), i.e. the polyethyleneimine/the polyester (D), is preferably from 1/1 to 1/4, more preferably from 1/1.3 to 1/3, and even more preferably from 1/1.5 to 1/2.5.

<17> The method according to any one of the above <1> to <16>, wherein the amide compound obtained by a reaction between the polyethyleneimine and the polyester (D) has a weight-average molecular weight of preferably 3,000 or more, more preferably 4,000 or more, and even more preferably 4,200 or more, and preferably 6,000 or less, more preferably 5,500 or less, even more preferably 5,000 or less, and even more preferably 4,800 or less.

<18> The method according to any one of the above <1> to <17>, wherein the amount of the basic dispersant used is preferably 1 part by mass or more, more preferably 2 parts by mass or more, even more preferably 3 parts by mass or more, and even more preferably 4 parts by mass or more, and preferably 20 parts by mass or less, more preferably 15 parts by mass or less, even more preferably 12 parts by mass or less, even more preferably 10 parts by mass or less, and even more preferably 8 parts by mass or less, based on 100 parts by mass of the toner particles.

<19> The method according to any one of the above <1> to <18>, wherein the insulating liquid has a viscosity at 25° C. of preferably 1 mPa·s or more, more preferably 2 mPa·s or more, and even more preferably 3 mPa·s or more, and preferably 55 mPa·s or less, more preferably 30 mPa·s or less, even more preferably 20 mPa·s or less, and even more preferably 10 mPa·s or less.

<20> The method according to any one of the above <1> to <19>, wherein the insulating liquid preferably contains an aliphatic hydrocarbon.

<21> The method according to any one of the above <1> to <20>, wherein the solid content concentration of the dispersion of toner particles is preferably 20% by mass or more, more preferably 30% by mass or more, and even more preferably 35% by mass or more, and preferably 50% by mass or less, more preferably 45% by mass or less, and even more preferably 40% by mass or less.

<22> The method according to any one of the above <1> to <21>, wherein the solid content concentration of the liquid developer obtained in the step 3 is preferably 20% by mass or more, more preferably 30% by mass or more, and even more preferably 35% by mass or more, and preferably 50% by mass or less, more preferably 45% by mass or less, and even more preferably 40% by mass or less.

<23> The method according to any one of the above <1> to <22>, wherein the toner particles in a liquid developer obtained in the step 3 have a volume-median particle size $D_{50}$ of preferably 5 μm or less, more preferably 3 μm or less, and even more preferably 2.5 μm or less, and preferably 0.5 μm or more, more preferably 1.0 μm or more, and even more preferably 1.5 μm or more.

<24> The method according to any one of the above <1> to <23>, wherein the liquid developer has a viscosity at 25° C. of preferably 200 mPa·s or less, more preferably 150 mPa·s or less, even more preferably 100 mPa·s or less, even more preferably 80 mPa·s or less, even more preferably 60 mPa·s or less, and even more preferably 50 mPa·s or less, and preferably 2 mPa·s or more, more preferably 5 mPa·s or more, even more preferably 10 mPa·s or more, and even more preferably 20 mPa·s or more.

<25> A method for producing a liquid developer containing toner particles containing a resin containing a polyester and a pigment, and an insulating liquid, wherein the toner particles are dispersed in the insulating liquid, including:

step 1: melt-kneading the resin and the pigment, and pulverizing and classifying a melt-kneaded mixture to provide toner particles;

step 2: dispersing the toner particles obtained in the step 1 in the insulating liquid in the presence of a basic dispersant to provide a dispersion of toner particles; and step 3: wet-milling the dispersion of toner particles obtained in the step 2 to provide a liquid developer, wherein the basic dispersant is an amide compound obtained by a reaction between a polyethyleneimine and a polyester (D) obtained by self-condensation of 12-hydroxystearic acid, wherein the polyethyleneimine has a number-average molecular weight of 1,000 or more and 2,600 or less, the polyester (D) has a number-average molecular weight of 1,000 or more and 2,500 or less, a molar ratio of the polyethyleneimine to the polyester (D), i.e. the polyethyleneimine/the polyester (D), is from 1/1 to 1/5, and the amide compound has a weight-average molecular weight of 2,000 or more and 7,500 or less.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester "CFT-500D," commercially available from Shimadzu Corporation, against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Glass Transition Temperature of Resin]

The glass transition temperature refers to a temperature of an intersection of the extension of the baseline of equal to or lower than the temperature of the maximum endothermic peak and the tangential line showing the maximum inclination between the kick-off of the peak and the top of the peak, wherein the endothermic peaks are measured by heating a 0.01 to 0.02 g sample weighed out in an aluminum pan to 200° C., cooling the sample from that temperature to 0° C. at a cooling rate of 10° C./min, and thereafter raising the temperature of the sample at a heating rate of 10° C./min, using a differential scanning calorimeter "DSC 210," commercially available from Seiko Instruments Inc.

[Acid Value (AV) of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Number-Average Molecular Weight (Mn) of Polyethyleneimine]

The number-average molecular weight is obtained by measuring a molecular weight distribution in accordance with a gel permeation chromatography (GPC) method as shown by the following method.

(1) Preparation of Sample Solution

A polyethyleneimine is dissolved in a solution prepared by dissolving $Na_2SO_4$ in a 1% aqueous acetic acid solution at 0.15 mol/L, so as to have a concentration of 0.2 g/100 ml. Next, this solution is filtered with a fluororesin filter "FP-200," commercially available from Sumitomo Electric Industries, Ltd., having a pore size of 0.2 μm, to remove insoluble components, to provide a sample solution.

(2) Measurement of Molecular Weight

The measurement is taken by allowing a solution prepared by dissolving $Na_2SO_4$ in a 1% aqueous acetic acid solution at 0.15 mol/L to flow through a column as an eluent at a flow rate of 1 ml per minute, stabilizing the column in a thermostat at 40° C., and loading 100 μl of a sample solution thereto. The molecular weight of the sample is calculated based on the previously drawn calibration curve. At this time, a calibration curve is drawn from several kinds of standard pullulans, commercially available from SHOWA DENKO K. K., P-5 ($5.9\times10^3$), P-50 ($4.73\times10^4$), P-200 ($2.12\times10^5$), and P-800 ($7.08\times10^5$) as standard samples.

Measurement Apparatus: HLC-8320GPC, commercially available from Tosoh Corporation Analyzing Column; α+α−M+α−M, commercially available from Tosoh Corporation

[Number-Average Molecular Weight (Mn) of Self-Condensate of 12-Hydroxystearic Acid]

The number-average molecular weight is obtained by measuring a molecular weight distribution in accordance with a gel permeation chromatography (GPC) method as shown by the following method.

(1) Preparation of Sample Solution

The condensate is dissolved in tetrahydrofuran, so as to have a concentration of 0.5 g/100 ml. Next, this solution is filtered with a fluororesin filter "FP-200," commercially available from Sumitomo Electric Industries, Ltd., having a pore size of 0.2 μm, to remove insoluble components, to provide a sample solution.

(2) Measurement of Molecular Weight

The measurement is taken by allowing tetrahydrofuran to flow through a column as an eluent at a flow rate of 1 ml per minute, stabilizing the column in a thermostat at 40° C., and loading 100 μl of a sample solution. The molecular weight of the sample is calculated based on the previously drawn calibration curve. At this time, a calibration curve is drawn from several kinds of monodisperse polystyrenes, commercially available from Tosoh Corporation, A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$) as standard samples.

Measurement Apparatus: HLC-8220GPC, commercially available from Tosoh Corporation Analyzing Column; GMHLX+G3000HXL, commercially available from Tosoh Corporation

[Weight-Average Molecular Weight (Mw) of Dispersant (Amide Compound)]

The weight-average molecular weight is obtained by measuring a molecular weight distribution in accordance with a gel permeation chromatography (GPC) method as shown by the following method.

(1) Preparation of Sample Solution

The dispersant is dissolved in chloroform, so as to have a concentration of 0.2 g/100 ml. Next, this solution is filtered with a fluororesin filter "FP-200," commercially available from Sumitomo Electric Industries, Ltd., having a pore size of 0.2 μm, to remove insoluble components, to provide a sample solution.

(2) Measurement of Molecular Weight

The measurement is taken by allowing a chloroform solution of FARMIN DM2098, commercially available from Kao Corporation at 100 mmol/L, to flow through a column as an eluent at a flow rate of 1 ml per minute, stabilizing the column in a thermostat at 40° C., and loading 100 μl of a sample solution. The molecular weight of the sample is calculated based on the previously drawn calibration curve. At this time, a calibration curve is drawn from several kinds of monodisperse polystyrenes, commercially available from Tosoh Corporation, A-500 ($5.0\times10^2$), A-5000 ($5.97\times10^3$), F-2 ($1.81\times10^4$), F-10 ($9.64\times10^4$), and F-40 ($4.27\times10^5$) as standard samples.

Measurement Apparatus: HLC-8220GPC, commercially available from Tosoh Corporation Analyzing Column; K-804L, commercially available from SHOWA DENKO K. K.

[Viscosities at 25° C. of Insulating Liquid and Liquid Developer]

A 6 mL glass sample vial "Vial with screw cap, No. 2," commercially available from Maruemu Corporation is charged with 4 to 5 mL of a measurement solution, and a viscosity at 25° C. is measured with a torsional oscillation type viscometer "VISCOMATE VM-10A-L," commercially available from SEKONIC CORPORATION.

[Volume-Median Particle Size of Toner Particles Obtained in the Step 1]

Measuring Apparatus: Coulter Multisizer II, commercially available from Beckman Coulter, Inc.

Aperture Diameter: 100 μm

Analyzing Software: Coulter Multisizer AccuComp Ver. 1.19, commercially available from Beckman Coulter, Inc.

Electrolytic Solution: "Isotone II," commercially available from Beckman Coulter, Inc.

Dispersion: "EMULGEN 109P," commercially available from Kao Corporation, polyoxyethylene lauryl ether, HLB: 13.6, is dissolved in the above electrolytic solution so as to have a concentration of 5% by mass to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

[Solid Content Concentrations in Dispersion of Toner Particles and in Liquid Developer]

Ten parts by mass of a dispersion of toner particles or a liquid developer is diluted with 90 parts by mass of hexane, and the dilution is rotated with a centrifuge "H-201F," commercially available from KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and the lower layer is then dried with a vacuum dryer at 0.5 kPa, 40° C. for 8 hours. The solid content concentration is calculated according to the following formula:

$$\text{Solid Content Concentration, \% by Mass} = \frac{\text{Mass of Residues After Drying}}{\text{Mass of Dispersion of Toner Particles or Liquid Developer, 10 Parts by Mass}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," commercially available from Malvern Instruments, Ltd., by charging a cell for measurement with "Isopar G," commercially available from Exxon Mobile Corporation, isoparaffin, under conditions that a particle refractive index is 1.58, imaginary part being 0.1, and a dispersion medium refractive index of 1.42, at a concentration that give a scattering intensity of from 5 to 15%.

Production Example 1 of Resin

A 10-L four-necked flask equipped with a nitrogen inlet tube, a dehydration tube, a stirrer, and a thermocouple was charged with raw material monomers, an esterification catalyst, and an esterification promoter, as listed in Table 1. The contents were heated to 230° C. and subjected to a reaction until a reaction percentage reached 90%, the reaction mixture was further subjected to a reaction at 8.3 kPa, and the reaction was terminated when a softening point reached 80° C., to provide a resin A having physical properties as shown in Table 1. Here, the reaction percentage as used herein means a value calculated by: [amount of generated water in reaction (mol)/theoretical amount of generated water (mol)]×100.

Production Example 2 of Resin

A 10-L four-necked flask equipped with a nitrogen inlet tube, a dehydration tube, a stirrer, and a thermocouple was charged with raw material monomers, an esterification catalyst, and an esterification promoter, as listed in Table 1. The contents were heated to 230° C. and subjected to a reaction until a reaction percentage reached 90%, the reaction mixture was further subjected to a reaction at 8.3 kPa, and the reaction was terminated when a softening point reached 99° C., to provide a resin B having physical properties as shown in Table 1.

Production Example 3 of Resin

A 10-L four-necked flask equipped with a nitrogen inlet tube, a dehydration tube, a stirrer, and a thermocouple was charged with raw material monomers other than trimellitic anhydride, an esterification catalyst, and an esterification promoter, as listed in Table 1. The contents were heated to 230° C. and subjected to a reaction until a reaction percentage reached 90%, and the reaction mixture was further subjected to a reaction at 8.3 kPa for 1 hour. Following the cooling of the reaction mixture to 210° C., trimellitic anhydride was added thereto, the reaction mixture was subjected to a reaction at 210° C., and the reaction was terminated when a softening point reached 104° C., to provide a resin C having physical properties as shown in Table 1.

Production Example 4 of Resin

A 10-L four-necked flask equipped with a nitrogen inlet tube, a dehydration tube, a stirrer, and a thermocouple was charged with raw material monomers, an esterification catalyst, and an esterification promoter, as listed in Table 1. The contents were heated to 230° C. and subjected to a reaction until a reaction percentage reached 90%, the reaction mixture was further subjected to a reaction at 8.3 kPa, and the reaction was terminated when a softening point reached 103° C., to provide a resin D having physical properties as shown in Table 1.

Production Example 5 of Resin

A 10-L four-necked flask equipped with a nitrogen inlet tube, a dehydration tube, a stirrer, and a thermocouple was charged with raw material monomers other than trimellitic anhydride, an esterification catalyst, and an esterification promoter, as listed in Table 1. The contents were heated to 230° C. and subjected to a reaction until a reaction percentage reached 90%, and the reaction mixture was further subjected to a reaction at 8.3 kPa for 1 hour. Following the cooling of the reaction mixture to 210° C., trimellitic anhydride was added thereto, the reaction mixture was subjected to a reaction at 210° C., and the reaction was terminated when a softening point reached 99° C., to provide a resin E having physical properties as shown in Table 1.

Production Example 6 of Resin

A 5-L four-necked flask equipped with a nitrogen inlet tube, a dehydration tube, a stirrer, and a thermocouple was charged with 1567 g of xylene. The contents were heated to 130° C. A liquid mixture of raw material monomers and a polymerization initiator as listed in Table 2 was added dropwise at 130° C. while stirring over 1.5 hours. Further, the reaction mixture was kept at the same temperature for 1.5 hours, to carry out an addition polymerization reaction. Following the heating of the reaction mixture to 160° C., and subjection to a reaction for 1 hour, the reaction mixture was heated to 200° C., and kept thereat for 1 hour to remove xylene. Further, the remaining xylene was removed at 8.3 kPa, to provide a resin F having physical properties as shown in Table 2.

Production Example 7 of Resin

A 10-L four-necked flask equipped with a nitrogen inlet tube, a dehydration tube, a stirrer, and a thermocouple was charged with raw material monomers, an esterification catalyst, and an esterification promoter, as listed in Table 1. The contents were heated to 180° C., and the reaction mixture was heated to 210° C. over 5 hours, and subjected to a reaction until a reaction percentage reached 90%. Further, the reaction mixture was subjected to a reaction at 8.3 kPa, and the reaction was terminated when a softening point reached 86° C., to provide a resin G having physical properties as shown in Table 1.

TABLE 1

| | | Resin A | Resin B | Resin C | Resin D | Resin E | Resin G |
|---|---|---|---|---|---|---|---|
| Raw Material Monomers | BPA-PO[1)] | 4473 g (60) | 4365 g (60) | 6901 g (100) | 4365 g (60) | 6739 g (100) | — |
| | BPA-EO[2)] | 2769 g (40) | 2702 g (40) | — | 2702 g (40) | — | — |
| | 1,2-Propanediol | — | — | — | — | — | 3640 g (100) |
| | Terephthalic Acid | 2758 g (78) | 2933 g (85) | 1964 g (60) | 2933 g (85) | 1598 g (50) | 6360 g (80) |
| | Trimellitic Anhydride | — | — | 1136 g (30) | — | 1663 g (45) | — |
| Esterification Catalyst | Dibutyltin Oxide | 50 g | 50 g | 50 g | 50 g | 50 g | 50 g |
| Esterification Promoter | Gallic Acid | 3 g | 3 g | 2 g | 3 g | 2 g | 5 g |
| Physical Properties of Resin | Softening Point (° C.) | 80 | 99 | 104 | 103 | 99 | 86 |
| | Glass Transition Temp. (° C.) | 50 | 62 | 66 | 64 | 61 | 47 |
| | Acid Value (mgKOH/g) | 12 | 5 | 70 | 1 | 110 | 10 |

Note)
The numerical values inside parenthesis show molar ratios when a total number of moles of the alcohol component is assumed to be 100.
[1)]BPA-PO: Polyoxypropylene(2.2)-2,2-bis(4-hydroxyphenyl)propane
[2)]BPA-EO: Polyoxyethylene(2.2)-2,2-bis(4-hydroxyphenyl)propane

TABLE 2

| | | Resin F |
|---|---|---|
| Raw Material Monomers | Styrene | 3750 g (84) |
| | 2-Ethylhexyl Acrylate | 1250 g (16) |
| Polymerization Initiator | Dibutyl Phthalate | 193 g |
| Physical Properties of Resin | Softening Point (° C.) | 100 |
| | Glass Transition Temp. (° C.) | 45 |
| | Acid Value (mgKOH/g) | 0 |

Note)
The numerical values inside parenthesis show molar ratios.

Production Example of Self-Condensate of 12-Hydroxystearic Acid, Polyester (D)

A 500-ml four-necked flask equipped with a nitrogen inlet tube, a dehydration tube, a stirrer, and a thermocouple was charged with 250 g of 12-hydroxystearic acid, commercially available from Tokyo Chemical Industry Co., Ltd., and 55 g of xylene as a reaction solvent, and 2.5 g of dibutyltin oxide as an esterification catalyst. The contents were heated to 190° C., the mixture was subjected to a reaction, and the reaction was terminated at a point that an acid value reached a value as listed in Table 3, to provide each of condensates a to e.

TABLE 3

| | Mn | AV (mgKOH/g) |
|---|---|---|
| Condensate a | 1,600 | 74 |
| Condensate b | 2,700 | 35 |
| Condensate c | 800 | 124 |
| Condensate d | 1,100 | 96 |
| Condensate e | 2,000 | 53 |

Production Example 1 of Amide Compound

A 100-mL three-necked flask was charged with 6.4 g of Polyethyleneimine 300, commercially available from JUNSEI CHEMICAL CO., LTD., number-average molecular weight: 1,500, and 68.6 g of a condensate a. The contents were heated to 150° C., and the mixture was subjected to a reaction until a reaction percentage reached 90%, to provide a dispersant a. Here, a reaction percentage is a value calculated by [(acid value before the reaction−acid value after the reaction)/acid value before the reaction]×100.

Production Example 2 of Amide Compound

The same procedures as in Production Example 1 were carried out except that 16.5 g of Polyethyleneimine 900, commercially available from JUNSEI CHEMICAL CO., LTD., number-average molecular weight: 2,580, was used in place of Polyethyleneimine 300, commercially available from JUNSEI CHEMICAL CO., LTD., number-average molecular weight: 1,500, and that the amount of the condensate a used was changed to 58.5 g, to provide a dispersant b.

Production Example 3 of Amide Compound

The same procedures as in Production Example 1 were carried out except that 20.5 g of Polyethyleneimine 1200, commercially available from JUNSEI CHEMICAL CO., LTD., number-average molecular weight: 2,640, was used in place of Polyethyleneimine 300, commercially available from JUNSEI CHEMICAL CO., LTD., number-average molecular weight: 1,500, and that the amount of the condensate a used was changed to 54.5 g, to provide a dispersant c.

Production Example 4 of Amide Compound

The same procedures as in Production Example 1 were carried out except that the amount of Polyethyleneimine 300 used was changed to 3.9 g, and that 71.1 g of a condensate b was used in place of the condensate a, to provide a dispersant d.

Production Example 5 of Amide Compound

The same procedures as in Production Example 1 were carried out except that the amount of Polyethyleneimine 300 used was changed to 11.8 g, and that 63.2 g of a condensate c was used in place of the condensate a, to provide a dispersant e.

Production Example 6 of Amide Compound

A 100-mL three-necked flask was charged with 3.4 g of Polyethyleneimine 300, commercially available from JUNSEI CHEMICAL CO., LTD., number-average molecular weight: 1,500, and 71.6 g of a condensate a. The contents were heated to 150° C., and the mixture was subjected to a reaction for 12 hours, to provide a dispersant f.

Production Example 7 of Amide Compound

The same procedures as in Production Example 6 were carried out except that the amount of Polyethyleneimine 300 used was changed to 2.3 g, and that the amount of the condensate a used was changed to 72.7 g, to provide a dispersant g.

Production Example 8 of Amide Compound

A 100-mL three-necked flask was charged with 4.2 g of tetraethylenepentamine, commercially available from KANTO CHEMICAL CO., INC., molecular weight: 189, and 70.8 g of a condensate a. The contents were heated to 150° C., and the mixture was subjected to a reaction for 12 hours, to provide a dispersant h.

Production Example 9 of Amide Compound

The same procedures as in Production Example 1 were carried out except that the amount of Polyethyleneimine 300 used was changed to 9.0 g, and that 66.0 g of the condensate d was used in place of the condensate a, to provide a dispersant i.

Production Example 10 of Amide Compound

The same procedures as in Production Example 1 were carried out except that the amount of Polyethyleneimine 300 used was changed to 5.2 g, and that 69.8 g of the condensate e was used in place of the condensate a, to provide a dispersant j.

The dispersants used in Examples and Comparative Examples are listed in Table 4.

TABLE 4

| | Mn of | Self-Condensate [Polyester (D)] | | | Polyethyleneimine/ | |
|---|---|---|---|---|---|---|
| | Polyethylene-Imine | Kinds | Mn | AV (mgKOH/g) | Polyester (D) (Molar Ratio) | Mw of Dispersant |
| Dispersant a | 1,500 | Condensate a | 1,600 | 74 | 1/2 | 4,500 |
| Dispersant b | 2,580 | Condensate a | 1,600 | 74 | 1/2 | 4,700 |
| Dispersant c | 2,640 | Condensate a | 1,600 | 74 | 1/2 | 4,900 |
| Dispersant d | 1,500 | Condensate b | 2,700 | 35 | 1/2 | 7,800 |

TABLE 4-continued

| | Mn of Polyethylene-Imine | Self-Condensate [Polyester (D)] Kinds | Mn | AV (mgKOH/g) | Polyethyleneimine/ Polyester (D) (Molar Ratio) | Mw of Dispersant |
|---|---|---|---|---|---|---|
| Dispersant e | 1,500 | Condensate c | 800 | 124 | 1/2 | 2,100 |
| Dispersant f | 1,500 | Condensate a | 1,600 | 74 | 1/4 | 5,300 |
| Dispersant g | 1,500 | Condensate a | 1,600 | 74 | 1/6 | 5,100 |
| Dispersant h | 189 | Condensate a | 1,600 | 74 | 1/2 | 2,900 |
| Dispersant i | 1,500 | Condensate d | 1,100 | 96 | 1/2 | 3,100 |
| Dispersant j | 1,500 | Condensate e | 2,000 | 53 | 1/2 | 5,800 |
| Dispersant k | Condensate formed between polyimine and carboxylic acid; SOLSPARSE 13940, commercially available from Lubrizol Corporation | | | | | 24,200 |
| Dispersant l | Condensate formed between polyallylamine and carboxylic acid; AJISPER PB-821, commercially available from Ajinomoto Fine-Techno Co., Inc. | | | | | — |

Examples 1 to 3, and 6 to 12 and Comparative Examples 1 to 6, and 8

[Step 1]

Resins as listed in Table 5 in an amount of 85 parts by mass each, and 15 parts by mass of a pigment "ECB-301," commercially available from DAINICHISEIKA COLOR & CHEMICALS MFG. CO., LTD., Phthalocyanine Blue, P.B. 15:3, were previously mixed with a 20-L Henschel mixer while stirring for 3 minutes at a rotational speed of 1500 r/min (a peripheral speed of 21.6 m/sec), and the mixture was melt-kneaded under the conditions given below.

[Melt-Kneading Conditions]

A continuous twin open-roller type kneader "Kneadex," commercially available from NIPPON COKE & ENGINEERING CO., LTD., outer diameter of roller: 14 cm, effective length of roller: 55 cm) was used. The operating conditions of the continuous twin open-roller type kneader are a rotational speed of a high-rotation roller (front roller) of 75 r/min (a peripheral speed of 32.4 m/min), a rotational speed of a low-rotation roller (back roller) of 35 r/min (a peripheral speed of 15.0 m/min), and a gap between the rollers at an end of the raw material supplying side of 0.1 mm. The temperatures of the heating medium and the cooling medium inside the rollers are as follows. The high-rotation roller had a temperature at the raw material supplying side of 90° C., and a temperature at the kneaded product discharging side of 85° C., and the low-rotation roller has a temperature at the raw material supplying side of 35° C., and a temperature at the kneaded product discharging side of 35° C. In addition, the feeding rate of the raw material mixture to the above kneader was 10 kg/h, and the average residence time in the above kneader was about 3 minutes.

The kneaded product obtained above was cooled with a cooling roller, and the cooled product was roughly pulverized to a size of 1 mm or so with a hammer-mill, and then finely pulverized and classified with an air jet type jet mill "IDS," commercially available from Nippon Pneumatic Mfg. Co., Ltd., to provide toner particles having a volume-median particle size $D_{50}$ of 10 μm.

[Step 2]

A 1-L polyethylene vessel was charged with 35 parts by mass of toner particles obtained in the step 1, 63.25 parts by mass of an insulating liquid "Lytol," commercially available from Sonneborn: liquid paraffin, viscosity: 5 mPa·s, and 1.75 parts by mass of a dispersant listed in Table 5, and the contents were stirred with "T.K. ROBOMIX," commercially available from PRIMIX Corporation, under ice-cooling at a rotational speed of 7000 r/min for 30 minutes, to provide a dispersion of toner particles having a solid content concentration of 37% by mass.

[Step 3]

The dispersion of toner particles obtained in the step 2 was subjected to wet milling with 6 vessels-type sand grinder "TSG-6," commercially available from AIMEX CO., LTD., at a rotational speed of 1300 r/min (a peripheral speed of 4.8 m/sec) using zirconia beads having a diameter of 0.8 mm at a volume filling ratio of 60% by volume until a volume-median particle size $D_{50}$ as listed in Table 5 was obtained. The beads were filtered off, to provide a liquid developer having physical properties as shown in Table 5.

Example 4

The same procedures as in Example 1 were carried out except that the step 2 was carried out in such a manner that the amount of the insulating liquid used was changed to 64.125 parts by mass, and the amount of the dispersant a used was changed to 0.875 parts by mass, respectively, to provide a liquid developer having physical properties as shown in Table 5.

Example 5

The same procedures as in Example 1 were carried out except that the step 2 was carried out in such a manner that the amount of the insulating liquid used was changed to 61.5 parts by mass, and the amount of the dispersant a used was changed to 3.5 parts by mass, respectively, to provide a liquid developer having physical properties as shown in Table 5.

Comparative Example 7

The same procedures as in Example 1 were carried out except that the step 2 was carried out in such a manner that the amount of the insulating liquid used was changed to 58.875 parts by mass, and 1.75 parts by mass of the dispersant a used was changed to 4.375 parts by mass of the dispersant k (active content: 40%), respectively, to provide a liquid developer having physical properties as shown in Table 5.

TABLE 5

| | Step 1 Toner Particles | | Step 2 Dispersion of Toner Particles | | | | | | Step 3 Liquid Developer | | |
|---|---|---|---|---|---|---|---|---|---|---|---|
| | Resin | Acid Value of Resin (mgKOH/g) | Dispersant | Mn of Poly-ethylene-imine | Mn of Polyester (D) | Poly-ethylene-imine/ Polyester (D) (Molar ratio) | Mw of Dispersant | Amount of Dispersant Used (parts by mass[1)]) | $D_{50}$ (μm) of Toner Particles | Viscosity (mPa · s) | Solid Content Concentration (% by mass) |
| Ex. 1 | Resin A | 12 | Dispersant a | 1,500 | 1,600 | 1/2 | 4,500 | 5 | 1.8 | 33 | 37 |
| Ex. 2 | Resin A | 12 | Dispersant b | 2,580 | 1,600 | 1/2 | 4,700 | 5 | 1.7 | 35 | 37 |
| Ex. 3 | Resin A | 12 | Dispersant f | 1,500 | 1,600 | 1/4 | 5,300 | 5 | 2.2 | 108 | 37 |
| Ex. 4 | Resin A | 12 | Dispersant a | 1,500 | 1,600 | 1/2 | 4,500 | 2.5 | 1.9 | 65 | 36 |
| Ex. 5 | Resin A | 12 | Dispersant a | 1,500 | 1,600 | 1/2 | 4,500 | 10 | 1.9 | 28 | 39 |
| Ex. 6 | Resin B | 5 | Dispersant a | 1,500 | 1,600 | 1/2 | 4,500 | 5 | 1.9 | 68 | 37 |
| Ex. 7 | Resin C | 70 | Dispersant a | 1,500 | 1,600 | 1/2 | 4,500 | 5 | 2.1 | 118 | 37 |
| Ex. 8 | Resin D | 1 | Dispersant a | 1,500 | 1,600 | 1/2 | 4,500 | 5 | 2.1 | 131 | 37 |
| Ex. 9 | Resin E | 110 | Dispersant a | 1,500 | 1,600 | 1/2 | 4,500 | 5 | 2.4 | 156 | 37 |
| Ex. 10 | Resin A | 12 | Dispersant i | 1,500 | 1,100 | 1/2 | 3,100 | 5 | 2.3 | 132 | 37 |
| Ex. 11 | Resin A | 12 | Dispersant j | 1,500 | 2,000 | 1/2 | 5,800 | 5 | 1.9 | 42 | 37 |
| Ex. 12 | Resin G | 10 | Dispersant a | 1,500 | 1,600 | 1/2 | 4,500 | 5 | 1.9 | 36 | 37 |
| Comp. Ex. 1 | Resin A | 12 | Dispersant c | 2,640 | 1,600 | 1/2 | 4,900 | 5 | 1.6 | 32 | 37 |
| Comp. Ex. 2 | Resin A | 12 | Dispersant d | 1,500 | 2,700 | 1/2 | 7,800 | 5 | 1.6 | 37 | 37 |
| Comp. Ex. 3 | Resin A | 12 | Dispersant e | 1,500 | 800 | 1/2 | 2,100 | 5 | 8.0 | >1,000 | 37 |
| Comp. Ex. 4 | Resin A | 12 | Dispersant g | 1,500 | 1,600 | 1/6 | 5,100 | 5 | 2.5 | 135 | 37 |
| Comp. Ex. 5 | Resin A | 12 | Dispersant h | 189 | 1,600 | 1/2 | 2,900 | 5 | 2.8 | 37 | 37 |
| Comp. Ex. 6 | Resin F | 0 | Dispersant a | 1,500 | 1,600 | 1/2 | 4,500 | 5 | | Solidified | |
| Comp. Ex. 7 | Resin A | 12 | Dispersant k | — | — | — | 24,200 | 5[2)] | 1.9 | 25 | 37 |
| Comp. Ex. 8 | Resin A | 12 | Dispersant l | — | — | — | — | 5[2)] | 9.0 | >1,000 | 37 |

[1)]The amount used based on 100 parts by mass of the toner particles.
[2)]Active Content Calculated (SOLSPARSE 13940: active content: 40%, AJISPER PB-821: active content: 100%)

Test Example 1

Storage Stability

A 20-mL glass sample vial "Vial with screw cap, No. 5," commercially available from Maruemu Corporation, was charged with 10 g of a liquid developer, and stored in a thermostat kept at 40° C. for 24 hours. The viscosities before and after storage were measured, to evaluate storage stability from the value calculated by [viscosity after storage]/[viscosity before storage]. The results are shown in Table 6. The more the number approximates 1, the more excellent the storage stability.

Test Example 2

Fusing Ability

A liquid developer was dropped on "POD Gloss Coated Paper," commercially available from Oji Paper Co., Ltd., cut into squares of 6 cm each side, and the paper was rotated using a spin-coater "MS-A150," commercially available from Mikasa Co., Ltd., to form a thin film. The liquid developer placed on the paper was adjusted with an amount dropped, a rotational speed, and rotation time so that the liquid developer was in an amount of 0.05 g±0.003 g.

The prepared thin film was kept in a thermostat at 150° C. for one minute to allow non-contact fusing. The resulting fused images were adhered to a mending tape "Scotch Mending Tape 810," commercially available from 3M, width of 18 mm, the tape was pressed with a roller so as to have a load of 500 g being applied thereto, and the tape was removed. The optical densities before and after tape removal was measured with a colorimeter "Spectroeye," commercially available from X-Rite. The fused image-printed portions were measured at 3 points each, and an average thereof was calculated as an optical density. A fusing ratio (%) was calculated from a value obtained by [optical density after removal]/[optical density before removal]×100, to evaluate fusing ability. The results are shown in Table 6. The larger the numerical values, the more excellent the fusing ability.

TABLE 6

| | Viscosity of Liquid Developer (mPa · s) | | Storage Stability | Fusing Ability [Fusing |
|---|---|---|---|---|
| | Before Storage X | After Storage Y | [Y/X] | Ratio (%)] |
| Ex. 1 | 33 | 34 | 1.03 | 94 |
| Ex. 2 | 35 | 41 | 1.17 | 92 |
| Ex. 3 | 108 | 115 | 1.06 | 82 |
| Ex. 4 | 65 | 69 | 1.06 | 96 |
| Ex. 5 | 28 | 29 | 1.04 | 87 |
| Ex. 6 | 68 | 74 | 1.09 | 91 |
| Ex. 7 | 118 | 135 | 1.14 | 90 |
| Ex. 8 | 131 | 192 | 1.47 | 91 |
| Ex. 9 | 156 | 186 | 1.19 | 82 |

TABLE 6-continued

| | Viscosity of Liquid Developer (mPa · s) | | Storage Stability | Fusing Ability [Fusing |
|---|---|---|---|---|
| | Before Storage X | After Storage Y | [Y/X] | Ratio (%)] |
| Ex. 10 | 132 | 158 | 1.20 | 92 |
| Ex. 11 | 42 | 45 | 1.07 | 86 |
| Ex. 12 | 36 | 39 | 1.08 | 92 |
| Comp. Ex. 1 | 32 | 66 | 2.06 | 91 |
| Comp. Ex. 2 | 37 | 39 | 1.05 | 72 |
| Comp. Ex. 3 | >1,000 | could not be dispersed | | |
| Comp. Ex. 4 | 135 | 169 | 1.25 | 75 |
| Comp. Ex. 5 | 37 | 212 | 5.73 | 77 |
| Comp. Ex. 6 | | Solidified | | |
| Comp. Ex. 7 | 25 | 45 | 1.80 | 77 |
| Comp. Ex. 8 | >1,000 | could not be dispersed | | |

As is clear from Table 6, it can be seen that the liquid developers of Examples 1 to 12 have excellent fusing ability and also storage stability, as compared to those of Comparative Examples 1 to 8.

The liquid developer obtained by the method of the present invention can be suitably used in development of latent images formed in, for example, an electrophotographic method, an electrostatic recording method, an electrostatic printing method, or the like.

What is claimed is:

1. A method for producing a liquid developer comprising toner particles comprising a resin comprising a polyester and a pigment, and an insulating liquid, wherein the toner particles are dispersed in the insulating liquid, comprising:

step 1: melt-kneading the resin and the pigment, and pulverizing a melt-kneaded mixture to provide toner particles;

step 2: dispersing the toner particles obtained in the step 1 in the insulating liquid in the presence of a basic dispersant to provide a dispersion of toner particles; and step 3: wet-milling the dispersion of toner particles obtained in the step 2 to provide a liquid developer, wherein the basic dispersant is an amide compound obtained by a reaction between a polyethyleneimine and a polyester (D) obtained by self-condensation of 12-hydroxystearic acid, wherein the polyethyleneimine has a number-average molecular weight of 1,000 or more and 2,600 or less, the polyester (D) has a number-average molecular weight of 1,000 or more and 2,500 or less, a molar ratio of the polyethyleneimine to the polyester (D), i.e. the polyethyleneimine/the polyester (D), is from 1/1 to 1/5, and the amide compound has a weight-average molecular weight of 2,000 or more and 7,500 or less.

2. The method for producing a liquid developer according to claim 1, wherein the polyester contained in the resin comprises a polyester (R) having an acid value of 3 mgKOH/g or more and 100 mgKOH/g or less.

3. The method for producing a liquid developer according to claim 1, wherein the amount of the basic dispersant used is 1 part by mass or more and 20 parts by mass or less, based on 100 parts by mass of the toner particles.

4. The method for producing a liquid developer according to claim 2, wherein the content of the polyester (R) is 90% by mass or more of the resin.

5. The method for producing a liquid developer according to claim 2, wherein the polyester (R) has an acid value of 8 mgKOH/g or more and 20 mgKOH/g or less.

6. The method for producing a liquid developer according to claim 1, wherein the polyester (D) has an acid value of 50 mgKOH/g or more and 110 mgKOH/g or less.

7. The method for producing a liquid developer according to claim 1, wherein the molar ratio of the polyethyleneimine to the polyester (D), i.e. the polyethyleneimine/the polyester (D), is from 1/1.5 to 1/2.5.

8. The method for producing a liquid developer according to claim 1, wherein the amide compound has a weight-average molecular weight of 4,200 or more and 5,500 or less.

9. The method for producing a liquid developer according to claim 1, wherein the polyethyleneimine has a number-average molecular weight of 1,400 or more and 1,800 or less.

10. The method for producing a liquid developer according to claim 1, wherein the polyester (D) has a number-average molecular weight of 1,500 or more and 1,800 or less.

11. The method for producing a liquid developer according to claim 1, wherein the insulating liquid has a viscosity at 25° C. of 3 mPa·s or more and 10 mPa·s or less.

12. The method for producing a liquid developer according to claim 1, wherein the content of the pigment is 5 parts by mass or more and 100 parts by mass or less, based on 100 parts by mass of the resin.

13. The method for producing a liquid developer according to claim 1, wherein the amount of the basic dispersant used is 4 parts by mass or more and 8 parts by mass or less, based on 100 parts by mass of the toner particles.

14. The method for producing a liquid developer according to claim 1, wherein the insulating liquid comprises an aliphatic hydrocarbon.

15. The method for producing a liquid developer according to claim 1, wherein the solid content concentration of the liquid developer obtained in the step 3 is 35% by mass or more and 40% by mass or less.

16. The method for producing a liquid developer according to claim 1, wherein the liquid developer obtained in the step 3 has a viscosity at 25° C. of 20 mPa·s or more and 50 mPa·s or less.

17. The method for producing a liquid developer according to claim 1, wherein the toner particles in the liquid developer obtained in the step 3 have a volume-median particle size of 1.5 μm or more and 2.5 μm or less.

18. A method for producing a liquid developer comprising toner particles comprising a resin comprising a polyester and a pigment, and an insulating liquid, wherein the toner particles are dispersed in the insulating liquid, comprising:

step 1: melt-kneading the resin and the pigment, and pulverizing a melt-kneaded mixture to provide toner particles;

step 2: dispersing the toner particles obtained in the step 1 in the insulating liquid in the presence of a basic dispersant to provide a dispersion of toner particles; and step 3: wet-milling the dispersion of toner particles obtained in the step 2 to provide a liquid developer, wherein the basic dispersant is an amide compound obtained by a reaction between a polyethyleneimine and a polyester (D) obtained by self-condensation of 12-hydroxystearic acid, wherein the polyethyleneimine has a number-average molecular weight of 1,400 or more and 1,800 or less, the polyester (D) has a number-average molecular weight of 1,500 or more and 1,800 or less, a molar ratio of the polyethyleneimine to the polyester (D), i.e. the polyethyleneimine/the polyester (D), is from 1/1.5 to 1/2.5, and the amide compound has a weight-average molecular weight of 4,200 or more and 5,500 or less, and the polyester contained in the resin comprises a polyester (R) having an acid value of 3 mgKOH/g or more and 100 mgKOH/g or less in an amount of 90% by mass or more of the resin.

* * * * *